US005631520A

United States Patent [19]

Inoue et al.

[11] Patent Number: 5,631,520

[45] Date of Patent: May 20, 1997

[54] COLOR CATHODE-RAY TUBE WITH NONSPHERICAL CURVED SHADOW MASK

[75] Inventors: Masatsugu Inoue, Kumagaya; Takashi Murai, Fukaya, both of Japan

[73] Assignee: Kabushiki Kaisha Toshiba, Kawasaki, Japan

[21] Appl. No.: 328,412

[22] Filed: Oct. 25, 1994

[30] Foreign Application Priority Data

Nov. 26, 1993 [JP] Japan ..... 5-295800

[51] Int. Cl.[6] ..... H01J 29/07

[52] U.S. Cl. ..... 313/402; 313/407; 313/408

[58] Field of Search ..... 313/402, 407, 313/408

[56] References Cited

U.S. PATENT DOCUMENTS

| | | | |
|---|---|---|---|
| 4,551,651 | 11/1985 | van der Ven | 313/402 |
| 4,837,482 | 6/1989 | Adachi et al. . | |
| 5,416,378 | 5/1995 | Andrevski | 313/408 |
| 5,424,603 | 6/1995 | Van Den Bekerom | 313/402 |

FOREIGN PATENT DOCUMENTS

| | | |
|---|---|---|
| 0304922 | 3/1989 | European Pat. Off. . |
| 59-163737 | 9/1984 | Japan . |
| 64-54645 | 3/1989 | Japan . |

*Primary Examiner*—Sandra L. O'Shea
*Assistant Examiner*—Vip Patel
*Attorney, Agent, or Firm*—Cushman Darby & Cushman, IP Group of Pillsbury Madison & Sutro, LLP

[57] ABSTRACT

A shadow mask of a color cathode-ray tube includes a mask body in the form of a substantially rectangular curved surface. The mask body has a center, horizontal and vertical axes perpendicularly crossing each other at the center, long sides extending in parallel to the horizontal axis, and short sides extending in parallel to the vertical axis. In a region of the mask body which is adjacent to the vertical axis, the radius of curvature in the vertical direction is smaller at portions of the mask body which are near the long sides than at the central portion of the mask body. In a intermediate region of the mask body between the vertical axis and each short side, the radius of curvature in the vertical direction is larger at the portions of the mask body which are near the long sides than at a portion adjacent to the horizontal axis.

8 Claims, 2 Drawing Sheets

COLOR CATHODE-RAY TUBE WITH NONSPHERICAL CURVED SHADOW MASK

BACKGROUND OF THE INVENTION

1. Field of the Invention

The present invention relates to a color cathode-ray tube of the shadow mask type and, more particularly, to a color cathode-ray tube capable of preventing images on the phosphor screen from being deteriorated by a thermal expansion of the shadow mask.

2. Description of the Related Art

Generally, a color cathode-ray tube comprises an envelope which includes a panel having a substantially rectangular effective surface formed of essentially a curved surface and a skirt portion provided at the periphery of the effective surface, and a funnel attached to the skirt portion of the panel. A phosphor screen comprising three-color phosphor layers which emit blue, green and red is formed on the inner side of the panel effective surface, and a substantially rectangular shadow mask is arranged inside and opposed to the phosphor screen. The shadow mask includes a mask body in the form of a curved surface and having a plurality of electron beam apertures in its area which is opposed to the phosphor screen, and a mask frame attached to the outer peripheral portion of the mask body.

An electron gun for emitting three electron beams is arranged in a neck of the funnel. Three electron beams emitted from the electron gun are deflected by magnetic field generated by a deflection yoke on the funnel and horizontally and vertically scan the phosphor screen through the shadow mask, thereby displaying a color image on the screen.

In order to display color images of good color purity on the phosphor screen, in the color cathode-ray tube constructed in this manner, the phosphor screen and the shadow mask must be arranged each other in a predetermined matching relation so that the three electron beams passing through the electron beam apertures of the shadow mask and entering into the phosphor screen correctly land on their corresponding three-color phosphor layers. To achieve this, it is important that, especially, the distance (or value q) between the inner face of the panel and the shadow mask is securely set as a designed value.

Even when the phosphor screen and the shadow mask are correctly arranged each other in the predetermined matching relation, however, the color cathode-ray tube deteriorates its color purity because of the thermal expansion of the shadow mask. Specifically, that area of the shadow mask in which the electron beam apertures are formed is smaller than ⅓ of the total area of the mask body. Most of electron beams, therefore, impinge against the shadow mask to thereby heat it. The mask body which is formed of a low carbon steel plate mainly including iron thus is heated to undergo thermal expand, and is subjected to doming such that it bulges toward the phosphor screen. As the result, the value q changes and the landing position of electron beams on the three-color phosphor layers also changes to thereby deteriorate color purity.

This change in the beam landing position (or mislanding) on the three-color phosphor layers caused by the thermal expansion of the shadow mask varies depending on image patterns on the phosphor screen and the time during which an image pattern is kept on the screen.

When images are displayed on the phosphor screen for a long time, the mask frame attached to the peripheral portion of the mask body and having a large heat capacity is also heated in addition to the mask body having a plurality of electron beam apertures, and they thermally expand together. The mislanding of electron beams caused by this thermal expansion can be effectively corrected by interposing bimetal elements between the mask frame and elastic supports for supporting the shadow mask, as disclosed in Jpn. Pat. Appln. KOKOKU Publication No. 44-3547.

If a high-luminance image is locally displayed for a relatively short period of time, the local mislanding of electron beams is caused, as a short time one. This local mislanding cannot be corrected by means of the bimetal elements. More specifically, when an image having a local high luminance is displayed on the phosphor screen by means of high current electron beams, the mask body 3 is subjected a local thermal expansion by the impingement of high current beams against it. In the thermally expanded portion of the shadow mask, each electron beam aperture is displaced from its normal position to an abnormal position. While the electron beams passing through the electron beam apertures which are positioned at the normal position correctly land on the three-color phosphor layers, those passing through the electron beam apertures which are positioned at the abnormal position cannot correctly land on the three-color phosphor layers. This mislanding of electron beams caused by the local thermal expansion of the mask body cannot be corrected by means of the bimetal elements because the thermal expansion is local.

The mislanding of electron beams caused in a short period of time was checked while changing the shape, size and position of a rectangular frame pattern generated by a signal generator. The mislanding of electron beams caused when a high current beam pattern is displayed substantially all over the phosphor screen is relatively small. When a high current beam pattern elongated in the vertical direction is displayed on the screen, however, it has been found that the mislanding of electron beams becomes largest in a case where the high current beam pattern is displayed on the portion of the phosphor screen which is slightly away from the horizontal end of the screen toward the center thereof.

The relationship between the high current beam pattern and the mislanding of electron beams can be described as follows.

A television set is usually designed in such a way that an average anode current applied to the cathode-ray tube should not exceed a given value. Therefore, when a large high-luminance beam pattern is formed on the phosphor screen, the beam current for each unit area of the shadow mask is lower, and the temperature rise of the mask is smaller, than when the small high-luminance beam pattern is formed. Further, when even the small high-luminance beam pattern is formed on the phosphor screen at the center portion thereof, the mislanding of electron beams cannot be easily caused even though the shadow mask is subjected to thermal expansion. As the originating position of the beam pattern shifts from the center of the phosphor screen toward the horizontal end portion thereof, the thermal expansion of the shadow mask appears, as the mislanding of electron beams, more frequently on the screen. However, near the peripheral portion of the phosphor screen, the shadow mask is attached to the mask frame, so that a deformation of the mask body caused by the thermal expansion is small. Accordingly, the mislanding of electron beams becomes largest not at the horizontal end portion of the phosphor screen but at the portion of the phosphor screen which is slightly away from the horizontal end toward the center of the screen.

Particularly in the FS (flat square) tube in which the effective area of the panel is made flat, the mask body is also made flat. The mislanding of electron beams is thus made more frequent by the thermal expansion of the shadow mask.

Disclosed in Jpn. Pat. Appln. KOKAI Publication Nos. 59-163737, 61-163539 and 61-88427 is means for restraining the mislanding of electron beams in the color cathode-ray tube, in which the effective area of the panel is flat, by changing the configuration of a flat shadow mask. However, the mislanding of electron beams cannot be fully corrected even if the configuration of the shadow mask is changed relative to the panel whose effective area is made flat.

Disclosed in Jpn. Pat. Appln. KOKAI Publication Nos. 64-17360 and 1-154443 is means for correcting the mislanding of the electron beams by changing the configuration of the effective area of the panel and that of the shadow mask. Even if this correction is made, however, a satisfactory effect cannot be obtained for a color cathode-ray tube having a substantially spherical flat panel which ensures a natural agreeable reflection on its outer surface and has recently stated to be used.

Further, the color cathode-ray tube whose panel has a flat effective surface involves the following problems, as well as the mislanding caused by the thermal expansion of the shadow mask.

In the color cathode-ray tube whose panel has a flat effective surface, the body of the shadow mask may be formed of a low-expansion material, such as Invar, besides a low-carbon steel sheet which is used for the shadow mask of a conventional color cathode-ray tube. Normally the shadow mask body is press-molded to have a predetermined curved surface after apertures are formed therein by photo-etching. In a conventional color cathode-ray tube whose mask body is formed of a curved surface with a relatively small radius of curvature, the mask body can be subjected to appropriate plastic deformation to obtain a necessary mechanical strength as it is press-molded. However, a flat shadow mask cannot be subjected to satisfactory plastic deformation and inevitably involves local low-strength portions, since the amount of deformation during the press-molding is small. Particularly in the case of the rectangular shadow mask, the central portions of the long and short sides of the mask body which are away from the corners of the mask, that is, the portions located near the ends of the horizontal and vertical axes of the mask body become low in mechanical strength. A countermeasure has been added to those portions of the mask body which are adjacent to the ends of the horizontal axis thereof, as disclosed in Jpn. Pat. Appln. KOKAI Publication No. 5-25885. However, those portions of the mask body which are adjacent to the ends of the vertical axis thereof are left unsolved and when impact and vibration are added to the shadow mask, therefore, those portion easily deform and resonant, causing a color drift.

SUMMARY OF THE INVENTION

The present invention is therefore intended to eliminate the above-mentioned drawbacks, and its object is to provide a color cathode-ray tube capable of preventing the mislanding of electron beams due to the thermal expansion of the shadow mask which is caused by the impingement of electron beams against the shadow mask, even if the shadow mask is of the conventional type having a relatively small radius of curvature or of the flat type having a large radius of curvature, and also capable of preventing deformation and resonance of the shadow mask even when impact and vibration are added to it.

In order to achieve the above object, a color cathode-ray tube according to the present invention comprises a substantially rectangular panel having a curved inner surface; a phosphor screen formed on the inner surface of the panel; and a shadow mask including a mask body having a plurality of electron beam apertures and being in the form of a substantially rectangular curved surface opposing to the phosphor screen, and a mask frame attached to the peripheral portion of the mask body. The mask body has a center through which a tube axis passes, a horizontal axis passing through the center and perpendicular to the tube axis, a vertical axis passing through the center and perpendicular to the tube and horizontal axes, long sides extending in parallel to the horizontal axis, and short sides extending in parallel to the vertical axis. The mask body is formed such that, in a region of the mask body which is adjacent to the vertical axis, the radius of curvature in a direction of the vertical axis is smaller at portions of the mask body which are near the long sides than at the central portion of the mask body and such that, in a region of the mask body which is located at a substantially intermediate between the vertical axis and each short side, the radius of curvature in a direction of the vertical axis is larger at portions of the mask body which are near the long sides than at a portion adjacent to the horizontal axis.

According to the color cathode-ray tube as described above, the mask body is formed such that, in the region adjacent to the vertical axis, its radius of curvature along a line parallel to the vertical axis is smaller at the portions near the longer sides of the mask body than at the central portion thereof. Thus, the portions of the mask body which are adjacent to the longer sides can be made higher in mechanical strength. Further, in the region of the shadow mask which is located at a substantially intermediate between the vertical axis and each shorter side of the mask body, the radius of curvature along a line parallel to the vertical axis is larger at the portions of the mask body which are near the longer sides than at the portion adjacent to the horizontal axis. Thus, local thermal expansion of the mask body can be suppressed and reduced.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIGS. 1 through 3 show a color cathode-ray tube according to an embodiment of the present invention, in which:

FIG. 1 is a longitudinal sectional view showing the color cathode-ray tube,

FIG. 2 is a front view showing a panel, and

FIG. 3 is a graph showing radius of curvature of a shadow mask along a vertical axis thereof and radius of curvature of the shadow mask along a line extending in parallel to the vertical axis and away from the center of the shadow mask in a horizontal axis by about 12 cm.

DETAILED DESCRIPTION OF THE PREFERRED EMBODIMENT

A color cathode-ray tube according to an embodiment of the present invention will be described in detail with reference to the accompanying drawings.

Figure 1:
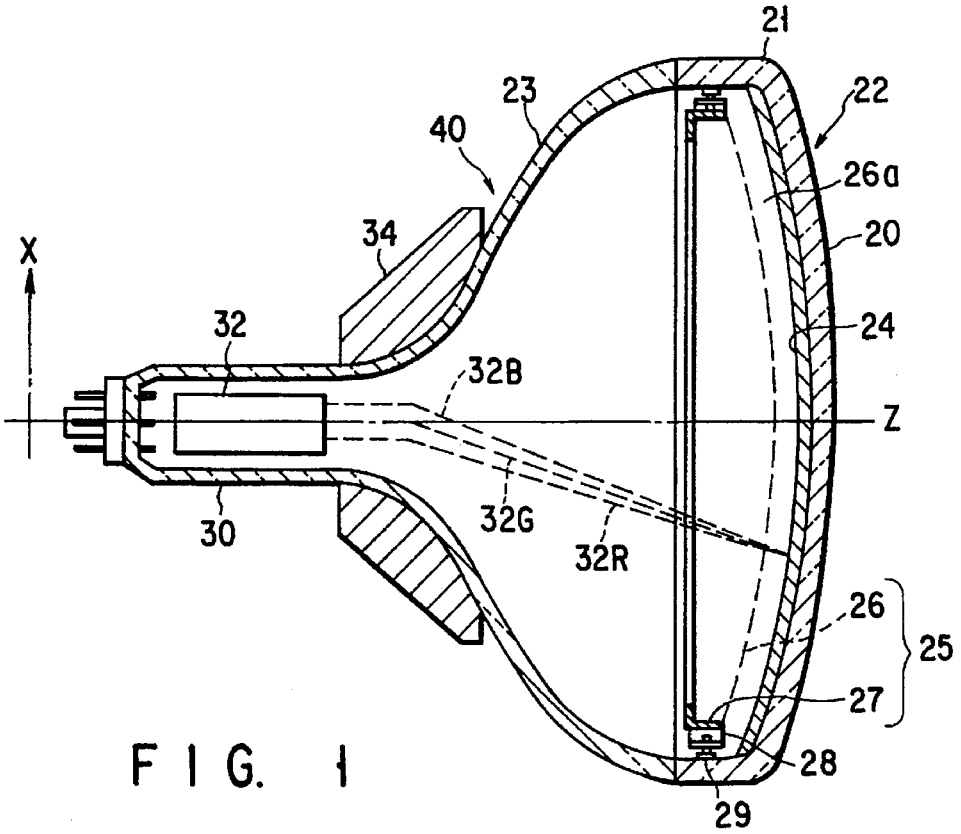
Figure 2:
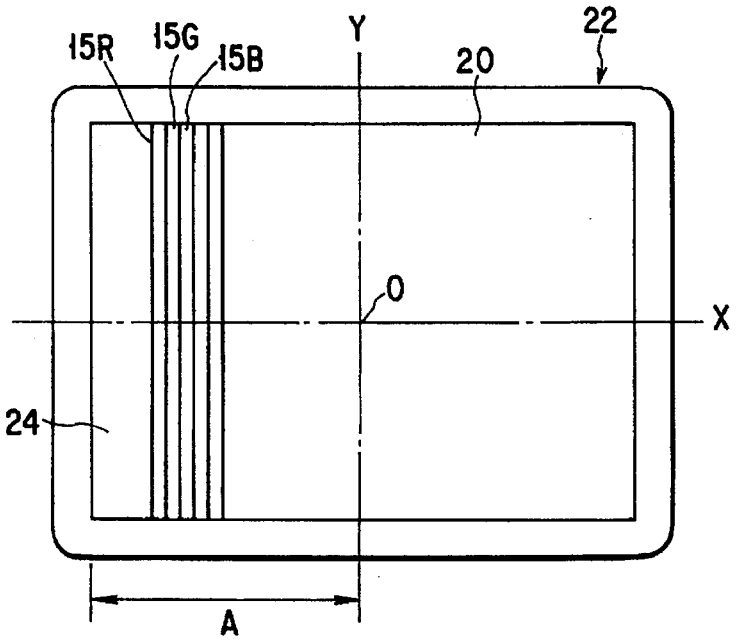

As shown in FIGS. 1 and 2, the color cathode-ray tube comprises an envelope 40 which includes a panel 22 having a substantially rectangular effective area 20 formed of essentially a curved surface and a skirt portion 21 provided at the peripheral portion of the effective area, and a funnel 23 attached to the skirt portion 21 of the panel. Formed on the inner surface of the curved effective area 20 of the panel 22 is a phosphor screen 24 made of stripe-shaped three color phosphor layers 15R, 15G and 15B which are arranged in a predetermined manner and emit red, green, and blue light beams, respectively.

A shadow mask 25 is arranged in the envelope 40, facing the phosphor screen 24. The shadow mask 25 includes a mask body 26 having a substantially rectangular effective surface opposing to the phosphor screen 24 and a skirt portion formed along the outer periphery of the effective surface, and a mask frame 27 attached to the skirt portion and having an L-shaped cross section. The effective surface is in the form of a curved surface and has a plurality of electron beam apertures **26*a* through which electron beams pass. Plural elastic supports 28 are attached to the outer side of the mask frame 27, and the shadow mask 25 is fixed inside the panel 22 in such a way that plural stud pins 29 on the inner face of the skirt section 21 of the panel 22 are fitted in holes formed in the elastic supports 28**, respectively.

On the other hand, an electron gun 32 is arranged in a neck 30 of the funnel 23 to emit three electron beams 32R, 32G and 32B in a line.

Three electron beams 32R, 32G and 32B emitted from the electron gun 32 are deflected by magnetic field generated by a deflection yoke 34 which is provided on the neck 30 of the funnel 23, and selected by the shadow mask 25 to scan the phosphor screen 24 in horizontal and vertical directions. A color image can be thus displayed on the effective area 20 of the panel 22.

The curved effective surface of the mask body 26 is a nonspherical surface expressed by the following equation:

$$z=-\sum_{i=0}^{2}\sum_{j=0}^{2}A_{3i+j}x^{2j}y^{2i}$$

where $A_{3i+j}$ is a coefficient and $A_0=0$, in the rectangular coordinate system of which the Z-axis extends through the center O of the effective surface and is coincident with the tube axis, the X-axis (or long axis) is a horizontal axis which extends through the center O and perpendicular to the X-axis, and the Y-axis (or short axis) is a vertical axis which extends through the center O and perpendicular to the Z-axis and the X-axis.

Figure 3:
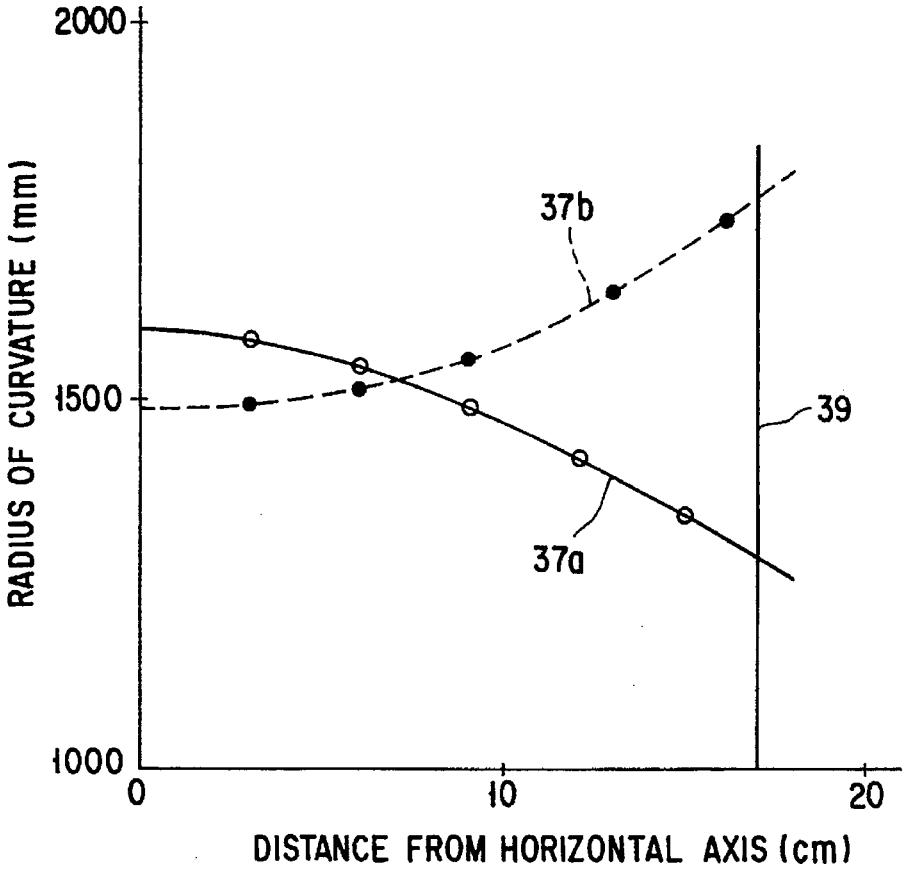
Figure 4:
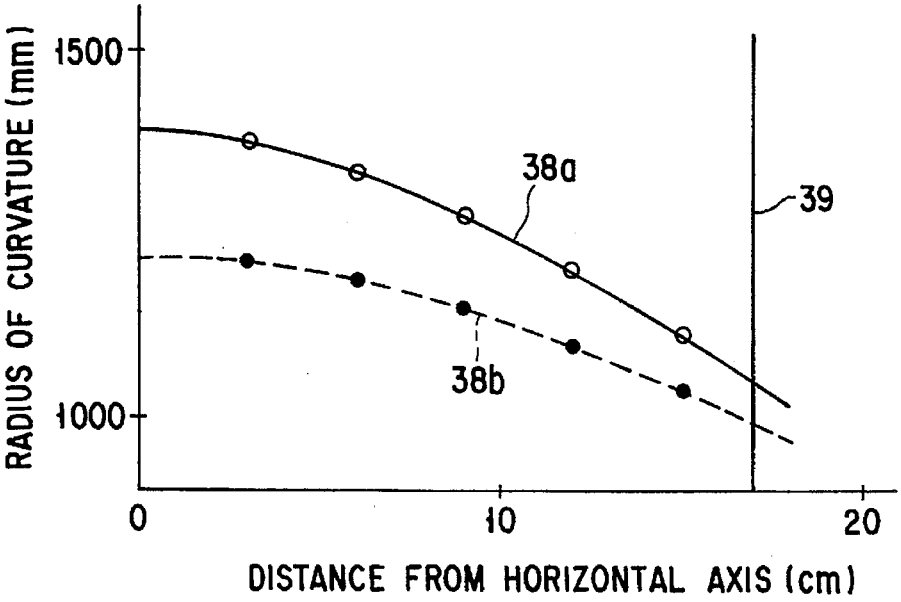
(PRIOR ART) F I G. 4
FIG. 4 is a graph showing radius of curvature of a conventional shadow mask along a vertical axis thereof and radius of curvature of the shadow mask along a line extending in parallel to the vertical axis and away from the center of the shadow mask in a horizontal axis by about 12 cm.

FIG. 3 shows radii of curvature at the effective surface of the mask body 26 of the shadow mask which is used for a 59 cm (or 25-inch) color cathode-ray tube, and designed based on the above-mentioned equation. In FIG. 3, a curve **37*a* represents radii of curvature in the vertical direction at that portion of the effective surface which is located on the vertical axis Y, and a curve 37*b* those at the intermediate portion of the effective surface, the intermediate portion being away form the center (which coincides with the center of the shadow mask) of the mask body in the horizontal direction by about 12 cm. FIG. 4 is a comparison example showing the curvature of a conventional shadow mask. In FIG. 4, a curve 38*a* denotes radii of curvature in the vertical direction at that portion of the effective surface of the mask body which is located on the vertical axis of the mask body, and a curve 38*b* those at the intermediate portion of the effective surface of the mask body, which is away from the center of the mask body in the horizontal direction by abut 12 cm. In FIGS. 3 and 4, a solid line 39** represents an end of the effective area, that is, a long side of the effective area.

As apparent from FIGS. 3 and 4, the conventional shadow mask has a curved surface, whose radii of curvature in the vertical direction at the portion on the vertical axis Y and at the intermediate portion become simply smaller and smaller from the center and the horizontal axis X of the mask body toward the long side thereof. According to the shadow mask of the present embodiment, however, the radius of curvature in the vertical direction at the portion located on the vertical axis Y becomes simply smaller and smaller from the center of the mask body toward the long side thereof, and the radius of curvature in the vertical direction at the intermediate portion, which is away form the center of the mask body in the horizontal direction by about 12 cm, becomes simply larger and larger from the horizontal axis X toward the long side of the mask body. The radius of curvature in the vertical direction at a region adjacent to the horizontal axis X in the intermediate portion of the mask body is smaller than that at the center of the mask body.

When the effective surface of the mask body is shaped according to the present embodiment, the radius of curvature in the vertical direction at the intermediate portion on the horizontal axis can be made efficiently small even in a mask body whose effective surface is flattened. As the result, the following advantages can be attained.

Specifically, in a mask body whose effective surface is flattened in accordance with a panel with a flattened effective surface, mislanding of electron beams due a thermal expansion is generated more frequent at the intermediate region of the mask body with respect to the horizontal axis. In order to prevent or suppress this mislanding which is caused by the thermal expansion, the radius of curvature in the vertical direction at the intermediate portion on the horizontal axis must be made small. This can be fully satisfied when the effective surface of the mask body is shaped according to the present invention.

On the other hand, in the portion on the vertical axis, the radius of curvature in the vertical direction at the regions adjacent to the long sides of the mask body (the regions adjacent to the ends of the vertical axis) is smaller than that at the center of the mask body. Upon the press molding the mask body, therefore, those regions adjacent to the long sides of the mask body can be fully plasticity deformed, thereby increasing their mechanical strength.

When the mask body is shaped, as described above, according to the present embodiment, therefore, it is possible to provide a color cathode-ray tube which is capable of totally reducing the mislanding of three electron beams, which is caused by thermal expansion and which is hard to deform and resonate even when impact and vibration are added to it.

Those regions of the mask body which are adjacent to the ends of the horizontal axis X (or adjacent to the short sides of the mask body), and the vertical end portions of those regions which form corners of the mask body are fixed to the mask frame 27, thus being hard to be subjected thermal expansion. Further, since those regions and the vertical end portions are adjacent to the skirt portion, their mechanical strength is high. For this reason, the radius of curvature in the vertical direction at the regions adjacent to the end of the horizontal axis X may be smaller or larger as it comes remoter from the horizontal axis X.

According to the present invention as described above, in the portion of the mask body of the substantially rectangular shadow mask which is located near the vertical axis of the mask body, the radius of curvature in the vertical direction at the regions near the long sides is smaller than that at the central portion of the mask body. In the intermediate portion of the mask body which is located between the center of the mask body and each of the long sides thereof, the radius of curvature in the vertical direction at the regions near the long sides is larger than that at the region near the horizontal axis. Thus, the local thermal expansion of the shadow mask, which is caused by its impingement with electron beams, can be suppressed to reduce the mislanding of electron beams only by partially changing the configuration of the curved surface of the mask body without greatly changing the configuration of the curved surfaces of the shadow mask and the panel. In addition, the shadow mask can be made higher in mechanical strength to more effectively prevent it from being deformed by impact added and also from being made resonant with vibration. The present invention is far more effective particularly when it is applied to a color cathode-ray tube having panel or shadow mask whose effective surface is made flat. In the present invention, the above-mentioned intermediate portion denotes an area away from the center O of the mask body to the end of the horizontal axis by about 0.4 A to 0.9 A, where A represents a distance between the center O and the end of the horizontal axis of the effective surface.

It should be understood that the present invention is not limited to the above-described embodiment and that it can be variously changed and modified within the scope of the present invention. Although the curvature of the effective surface of the mask body of the shadow mask, for example, has been described in the above-mentioned embodiment, it is usually designed and set considering the inner surface curvature of the panel and the distance between the inner surface of the panel and the mask body. Therefore, the curvature radius of the effective surface of the mask body used in the above-described embodiment can also be applied to the inner surface of the effective area of the panel.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A color cathode-ray tube comprising:

a substantially rectangular panel having a curved inner surface;

a phosphor screen formed on the inner surface of the panel; and a shadow mask including a mask body having a substantially rectangular effective surface which includes a plurality of electron beam apertures and which has nonspherical curved surface shape opposing the phosphor screen, and a mask frame attached to a peripheral portion of the mask body, a tube axis being defined as passing through a center of the main body, a horizontal axis being defined as passing through the center in a direction perpendicular to the tube axis, a vertical axis being defined as passing through the center in a direction perpendicular to the tube axis and the horizontal axis, long sides of the effective surface extending parallel with the horizontal axis, and short sides of the effective surface extending parallel to the vertical axis, wherein along the vertical axis, a radius of curvature of the effective surface is smaller at portions of the effective surface which are near the long sides than at the central portion of the effective portion, and wherein along a vertical line that is parallel to the vertical axis and that is offset from the center of the effective surface, the radius of curvature of the effective surface is larger at the portions of the effective surface which are near the long sides than at a portion of the effective surface that is adjacent to the horizontal axis.

2. A color cathode-ray tube according to claim 1, wherein, in a region of the effective surface which is near the horizontal axis, the radius of curvature of the effective surface along a vertical line is smaller than the radius of curvature of the effective surface along the vertical axis passing through the central portion of the effective surface, where the vertical line is parallel to the vertical axis and where the vertical line passes through an intermediate portion of the effective surface that is midway between the central portion of the effective surface and each short side.

3. A color cathode-ray tube according to claim 1, wherein the radius of curvature for the effective surface increases from a vertical center of the effective surface toward at least one of the long sides of the effective surface, along a vertical axis that is offset from the horizontal center of the effective surface.

4. A color cathode-ray tube according to claim 1, wherein the radius of curvature for the effective surface decreases in a horizontal direction from the effective surface center to a portion of the effective surface located between the effective surface center and each short side of the effective surface, and wherein the radius of curvature for the effective surface increases from a vertical center of the effective surface toward at least one of the long sides of the effective surface, along a vertical axis that is offset from the horizontal center of the effective surface.

5. A color cathode-ray tube comprising:

a substantially rectangular panel;

a phosphor screen formed on the inner surface of the panel; and a shadow mask including a mask body having a substantially rectangular effective surface, a radius of curvature for the effective surface decreasing in a vertical direction from an effective surface center toward at least one of an upper and lower edge of the effective surface, wherein the radius of curvature for the effective surface increases from a vertical center of the effective surface toward at least one of an upper and lower edge of the effective surface, along a vertical axis that is offset from a horizontal center of the effective surface.

6. A color cathode-ray tube comprising:

a substantially rectangular panel;

a phosphor screen formed on the inner surface of the panel; and a shadow mask including a mask body having a substantially rectangular effective surface, a radius of curvature for the effective surface decreasing in a vertical direction from an effective surface center toward at least one of an upper and lower edge of the effective surface, wherein the radius of curvature for the effective surface decreases in a horizontal direction from an effective surface center to a portion of the effective surface located between the effective surface center and a lateral edge of the effective surface, and wherein the radius of curvature for the effective surface increases from a vertical center of the effective surface toward at least one of an upper and lower edge of the effective surface, along a vertical axis that is offset from a horizontal center of the effective surface.

7. A color cathode-ray tube comprising:

a substantially rectangular panel;

a phosphor screen formed on the inner surface of the panel; and a shadow mask including a mask body having a substantially rectangular effective surface, a radius of curvature for the effective surface increasing from a vertical center of the effective surface toward at least one of an upper and lower edge of the effective surface, along a vertical axis that is offset from a horizontal center of the effective surface.

8. A color cathode-ray tube according to claim 7, wherein the radius of curvature for the effective surface decreases in a horizontal direction from an effective surface center to a portion of the effective surface located between the effective surface center and a lateral edge of the effective surface.

* * * * *